US005369894A

United States Patent [19]

Schaffer et al.

[11] Patent Number: 5,369,894

[45] Date of Patent: Dec. 6, 1994

[54] METHOD OF AND APPARATUS FOR DRYING RUNNING WEBS OF PHOTOGRAPHIC MATERIAL

[75] Inventors: Herbert Schaffer, Grünwald; Horst Kreiner, Kirchheim; Karl-Heinz Bauer, Münichen, all of Germany

[73] Assignee: AGFA-Gevaert Aktiengesellschaft, Leverkusen, Germany

[21] Appl. No.: 18,740

[22] Filed: Feb. 17, 1993

[30] Foreign Application Priority Data

Feb. 27, 1992 [DE] Germany ..... 4206048

[51] Int. Cl.[5] ..... F26B 3/34

[52] U.S. Cl. ..... 34/268; 34/549; 34/273

[58] Field of Search ..... 34/4, 41, 155, 266, 34/268, 269, 273, 444, 445, 493, 549, 550, 611, 618; 250/504 R

[56] References Cited

U.S. PATENT DOCUMENTS 3,900,959 8/1975 Breschi et al. ..... 34/41
4,485,565 12/1984 Ertl ..... 34/4
4,665,627 5/1987 Wilde et al. ..... 34/4
4,756,091 7/1988 Van Denend ..... 34/4
4,882,992 11/1989 Schmoeger ..... 34/4

FOREIGN PATENT DOCUMENTS 0383484 8/1990 European Pat. Off. .

*Primary Examiner*—Denise L. Gromada
*Attorney, Agent, or Firm*—Darby & Darby

[57] ABSTRACT

A moist web of exposed and developed photographic film or photographic paper is continuously advanced through a drying unit wherein selected areas of the path for the web are monitored by devices which generate signals denoting the heat absorptivity of monitored portions of the web. Such signals are processed and utilized to regulate the intensity of heat which is emitted by batteries of heating elements at both sides of the path for the running web. This ensures that the less developed portions of the web are subjected to sufficient heating action and that the more developed portions of the web are not overheated. The monitoring can involve ascertaining the intensity of heat which has penetrated through successive portions of the running web and/or ascertaining the intensity of heat which is reflected by successive portions of the running web and issues from heating elements designed to emit heat of known intensity.

16 Claims, 2 Drawing Sheets

D
T
1
2
3
4
5
6
7
8

METHOD OF AND APPARATUS FOR DRYING RUNNING WEBS OF PHOTOGRAPHIC MATERIAL

BACKGROUND OF THE INVENTION

The invention relates to the treatment of running webs of photographic material, such as exposed and developed photographic films or exposed and developed strips or sheets of photographic paper. More particularly, the invention relates to improvements in methods of and in apparatus for drying moist or wet webs which contain photographic material. As used herein, the term "web" or "webs" is intended to embrace elongated strips as well as discrete sheets of photographic material.

Commonly owned U.S. Pat. No. 4,485,565 granted Dec. 4, 1984 to Franz Ertl et al. discloses an apparatus for drying running strips or sheets of photographic material. In accordance with a feature of the patented invention, the intensity of heat which is radiated by a plurality of heating elements against a running strip or sheet can be varied depending upon the characteristics of the material to be dried. The intensity of radiated heat is selected in advance and remains unchanged in the course of the drying operation. A drawback of such proposal is that the patented apparatus is not ideally suited for the drying of webs of photographic material wherein randomly distributed portions exhibit widely different heat absorptivities due to pronounced differences of opacity. Thus, if a running web includes randomly distributed portions having widely different heat transmissivities, any advance adjustment of the intensity of heat which is directed against and is supposed to reduce the moisture content of a running web is highly unlikely to ensure a desirable uniform drying of the web. The reason is that the less exposed portion of an exposed and developed web is lighter and thus absorbs less heat than a darker portion, i.e., a portion which was exposed to a larger amount of light and is more opaque than the less exposed portion. If a fixed intensity of heat is selected in advance of transport of a web through the drying station, the less exposed portions of the web are likely to be adequately dried and/or the more exposed portions are likely to be damaged as a result of overheating.

The situation is analogous with certain other types of webs (sheets or strips) of photographic material which are to be dried by exposure to radiated heat.

OBJECTS OF THE INVENTION

An object of the invention is to provide a method which renders it possible to reduce the moisture content of running webs of photographic material regardless of random distribution of more and less exposed portions in the running web.

Another object of the invention is to provide a method which renders it possible to subject a freshly developed web of photographic material to an accurately predictable drying action.

A further object of the invention is to provide a method which renders it possible to avoid insufficient drying of less exposed portions and/or overheating of more exposed portions of a running moist or wet web of photographic material.

An additional object of the invention is to provide a simple and inexpensive method which ensures automatic adjustment of the drying action and does not require any advance adjustments of the intensity of heat which is to be directed against a running web of photographic material.

Still another object of the invention is to provide a novel and improved apparatus for the practice of the above outlined method.

A further object of the invention is to provide an apparatus which can automatically regulate the intensity of heat that is used to reduce the moisture content of a running web of photographic material.

Another object of the invention is to provide an apparatus which can uniformly dry a running web of photographic material regardless of the exact distribution of more and less exposed portions in the running web.

An additional object of the invention is to provide the apparatus with novel and improved means for adjusting the intensity of heat which is being directed against a running web of photographic material.

Still another object of the invention is to provide an apparatus which can be installed in existing developing machines for webs of photographic material.

SUMMARY OF THE INVENTION

One feature of the present invention resides in the provision of a method drying a moist or wet web which contains photographic material and comprises randomly distributed portions having different heat absorptivities. The improved method comprises the steps of advancing the web in a predetermined direction along a predetermined path, directing heat of variable intensity against the advancing web in at least one predetermined section of the path whereby the randomly distributed portions having different heat absorptivities absorb different quantities of heat, monitoring the absorptivity of the randomly distributed portions in the at least one section of the path and generating signals which denote the monitored absorptivities, and utilizing the signals to vary the intensity of directed heat.

The monitoring step can include ascertaining the amounts of heat which penetrate through the randomly distributed portions of the advancing web and/or ascertaining the amounts of heat which is reflected by the randomly distributed portions of the advancing web.

The method can further comprise the steps of monitoring the intensity of heat prior to impingement upon the advancing web in the at least one section of the path and generating second signals which denote the monitored intensity, and comparing the second signals with signals denoting the monitored absorptivity. The utilizing step of such method preferably comprises varying the intensity of directed heat as a function of differences between the compared signals.

The heat directing step can include directing heat against both sides of the advancing web in the at least one section of the path.

The advancing step can include transporting the web along the at least one section of the path in a predetermined plane, and the heat directing step of such method can include directing heat of variable intensity against at least one side of the advancing web at least substantially at right angles to the predetermined plane. The heat directing step of such method can comprise directing heat from a plurality of sources forming at least one row disposed at the at least one side of the predetermined plane and being at least substantially equidistant from the plane. The row preferably extends transversely of the predetermined direction.

Another feature of the present invention resides in the provision of an apparatus for drying a moist (wet) web which contains photographic material and comprises randomly distributed portions having different heat absorptivities and is advanced in a predetermined direction along a predetermined path. The improved apparatus comprises adjustable means for directing heat of variable intensity against the advancing web in at least one predetermined section of the path whereby the randomly distributed portions of the web absorb different quantities of heat, means for monitoring the absorptivity of the randomly distributed portions of the advancing web in the at least one section of the path including means for generating signals which denote the monitored absorptivity, and means for adjusting the directing means as a function of variations of the signals.

The heat directing means can comprise at least one array of adjustable heating elements extending transversely of the predetermined direction at least at one side of the predetermined path.

The monitoring means can include means for monitoring the transmissivity of heat by the randomly distributed portions of the advancing web.

The apparatus can further comprise means for limiting the range of the monitoring means. Such limiting means can comprise means for confining the monitoring means to monitoring of a predetermined part of the web in the at least one section of the path.

The apparatus can further comprise means for directly monitoring the intensity of heat prior to impingement of directed heat upon the web in the at least one section of the path including means for generating second signals which denote the monitored intensity of heat. The adjusting means of such apparatus preferably includes means for adjusting the directing means as a function of the second signals.

The heat directing means can include a battery of adjustable heating elements at each side of the web in the at least one section of the path.

If the heat directing means includes a plurality of adjustable heating elements, the means for monitoring the absorptivity of randomly distributed portions of the running web can include a discrete monitoring device (e.g., a photodiode) for each adjustable heating element. Analogously, the means for directly monitoring the intensity of heat directed by the heating elements can also comprise a discrete intensity monitoring device for each adjustable heating element.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
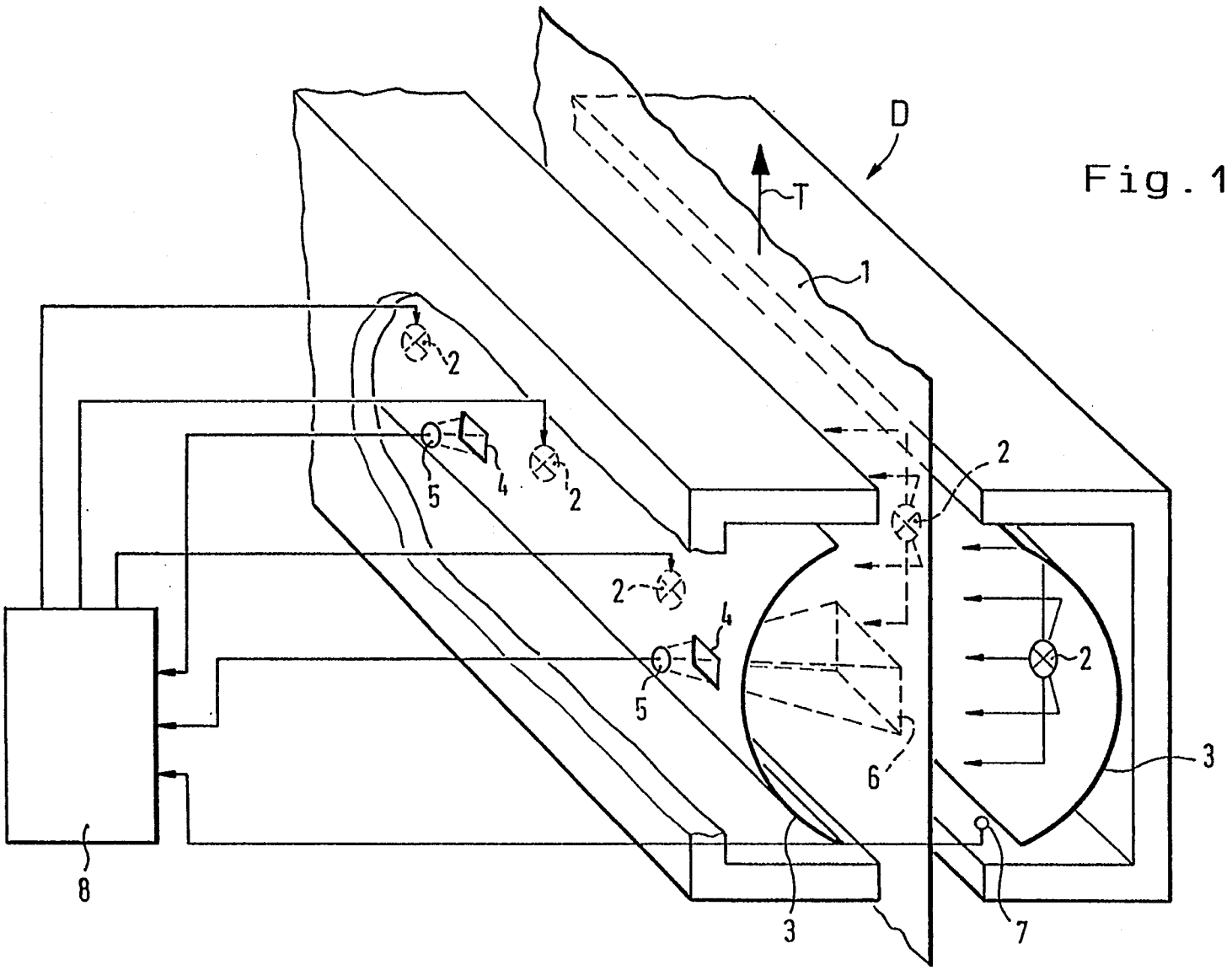
FIG. 1 is a fragmentary partly schematic perspective view of an apparatus which embodies one form of the invention and is equipped with two sets of monitoring means for the generation of signals which are used to regulate the intensity of heat being applied to both sides of a running web of photographic material.

FIG. 1 illustrates an exposed and developed web 1 of photographic material (e.g., a customer film) which is advanced in the direction of arrow T in a vertical plane by customary advancing rolls (not shown) of the type employed in developing machines of photographic laboratories. Reference may be had to the commonly owned U.S. Pat. No. 4,485,565 to Ertl et al. The illustrated part of the film 1 is in the process of advancing through a drying apparatus or unit D which is the last unit in a standard developing machine and wherein the film is relieved of excess moisture, such as a rinsing liquid through which the film 1 was caused to advance subsequent to advancement through a developing bath and thereupon through a fixing bath.

The drying unit D comprises two arrays of heating elements 2, one at each side of the vertical plane for the advancing web 1. Each array is in the form of a row which extends transversely of the direction indicated by the arrow T and wherein the heating elements 2 may but need not be equidistant from each other. The heating elements 2 of each array can be and preferably are disposed at the same distance from the respective side of the advancing web 1. The drying unit D further comprises two concavo-convex mirrors 3, one at each side of the web 1, which serve to direct heat issuing from the respective array of heating elements 2 against the corresponding side of the web.

Each mirror 3 is provided with a window 4 for each of the respective array of heating elements 2. For the sake of simplicity, the drawing merely shows two windows 4 for two monitoring devices 5 having signals transmitting outputs connected to the corresponding inputs of a control circuit 8. Each monitoring device 5 monitors a selected part of the path for the advancing web 1; in the illustrated embodiment, the windows 4 are designed in such a way that each device 5 monitors a rectangular part of the path for the web 1. The purpose of each monitoring device 5 is to generate and transmit a signal denoting the intensity of heat which issues from a heating element 2 at the other side of the path of the web 1, i.e., to ascertain the intensity of heat which has penetrated through the web 1 and thereupon through the respective window 4 in the mirror 3 at the left-hand side of the vertical plane of the illustrated portion of the web. The windows 4 limit the range of the corresponding monitoring devices 5.

A second monitoring device 7 (called reference sensor) is disposed at the right-hand side of the path for the web 1, i.e., at the side opposite that which confronts the illustrated monitoring devices 5. The purpose of the monitoring device or reference sensor 7 is to transmit to the corresponding input of the control circuit 8 second signals which denote the intensity of heat issuing from one or more heating elements 2 at the right-hand side of the path for the web 1 prior to impingement of such heat upon the advancing web.

The control circuit 8 evaluates and processes the signals from the monitoring devices 5, 7 and adjusts the intensity of heat issuing from one or both arrays of heating elements 2 in dependency upon variations of characteristics (such as intensities) of the evaluated signals. Evaluation of signals from the monitoring devices 5 and 7 enables the control circuit 8 to ascertain the transmissivity of those portions of the advancing web 1 which are then in register with the areas 6 monitored by the devices 5. An advantage of employing two or more monitoring devices 5, each of which monitors a different zone 6 of the path for the film 1, is that the control circuit 8 can ascertain an average transmissivity of the monitored film, namely the average transmissivity of that length of the advancing web 1 which happens to be located in the drying unit D. The transmissivity is indicative of the extent to which various randomly distributed portions of the advancing web or film 1 can absorb heat. If the absorptivity is pronounced, the transmissivity is low and vice versa. Signals from the control circuit 8 are used, in a manner well known per se, to automatically adjust the intensity of heat issuing from the heating elements 2 in the one and/or the other array.

As the web 1 advances in the direction of arrow T, successive portions of such web move into register with the areas 6 and are monitored by the devices 5 which transmit corresponding signals to the control circuit 8. This ensures that the intensity of heat issuing from the heating elements 2 is varied (when necessary) at the rate at which the heat transmissivity of successive web portions moving into register with the areas 6 changes. It has been found that the improved apparatus can react (when necessary) to randomly distributed changes of heat transmissivity of successively monitored portions of the advancing web 1 so that the drying action of the unit D is much more satisfactory than that of conventional drying units. Thus, the less developed portions of the web are adequately dried and the more developed portions of the film are not damaged as a result of overheating.

In accordance with a modification, the monitoring devices 5 can be designed to constitute means for generating signals denoting the intensity of heat which is reflected by heating elements 2 at the same side of the advancing web 1. The ability of the web to absorb heat can be ascertained on the basis of monitored heat reflectivity. Thus, all that is necessary is to employ heating elements 2 which are designed to emit heat of known intensity and to ascertain the intensity of heat which is reflected by such heating elements. This enables the monitoring devices and/or the control circuit 8 to continuously transmit signals denoting the heat absorptivity of momentarily monitored portions of the advancing web and to adjust the heating elements 2 accordingly.

An important advantage of the improved method and apparatus is their simplicity. Thus, all that is necessary is to continuously monitor the heat absorptivity of the running web of photographic material and to regulate the intensity of heat which is being directed against the web in dependency on changes of intensity and/or other characteristics of signals which are generated to denote the ascertained absorptivity. Such regulation of heating action ensures that the advancing web is subjected to an optimal drying action regardless of the random distribution of more and less exposed web portions. Consequently, less exposed portions are subjected to more intensive drying than in heretofore known drying units wherein the intensity of heat is selected in advance and remains unchanged in the course of drying, and the more exposed portions are not overheated and hence not damaged on their way through the drying unit, e.g., on their way into a copying unit wherein successive or selected frames of an exposed, developed and dried customer film are imaged onto photographic paper.

Figure 2:
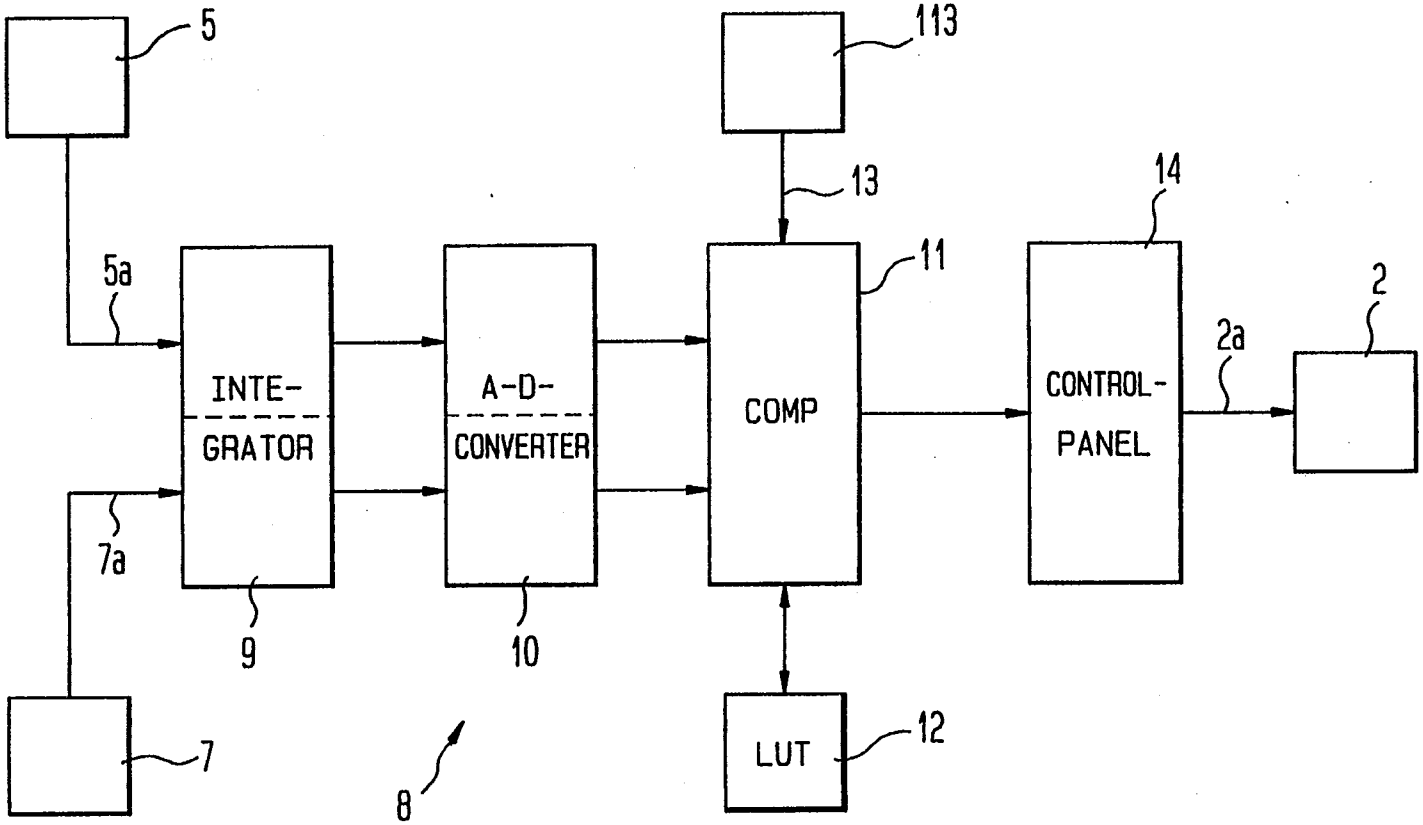
FIG. 2 is a block diagram of presently preferred means for adjusting the intensity of heat which is being directed against a running web.

FIG. 2 illustrates a portion of one presently preferred control circuit 8 which serves as a means for adjusting the heating elements 2 in response to variations of intensities and/or other characteristics of signals from the monitoring devices 5 and/or 7. This control circuit evaluates the first signals (from 5) denoting the intensity of radiation passing through those portions of the web 1 which are located in the path section between the mirrors 3 and adjusts the heating action of the elements 2 accordingly. It is presently preferred to provide a discrete monitoring device 5 and a discrete monitoring device 7 for each heating element 2, or at least for each heating element 2 at one side of the path for the web 1.

The monitoring device 5 which is shown in FIG. 2 comprises a photodiode which transmits photocurrent or photovoltage through a conduit 5*a* to the corresponding input of an integrator 9 wherein the signals are integrated with a suitable time constant and transmitted to the memory of a computer (CPU) 11 through an analog-digital converter 10. The other monitoring device 7 (reference sensor) of FIG. 2 transmits second signals through a conductor 7*a* to the corresponding input of the integrator 9 where the signals are integrated with the same time constant as that selected in connection with integration of signals from the monitoring device 5. The integrated second signals are also stored in the memory of the computer 11 which receives such signals through the analog-digital converter 10. The computer 11 ascertains the quotient of the integrated first and second signals, and such quotient is indicative of average density or opacity of monitored portions of the running web 1. The quotient is used to ascertain, in a comparison table or chart (LUT) 12, a required or optimum value of heating action of the corresponding heating element 2. A signal denoting the thus ascertained optimum value is transmitted from the output of the computer 11 to a control panel 14 which, in turn, transmits appropriate signals via conductor 2*a* to the respective heating element 2 so that the latter is adjusted accordingly.

The character 13 denotes in FIG. 2 a computer input which is connected with the output of a further system 113, for example, the developing machine which treats successive webs 2 prior to entry of such webs into the drying unit D.

The drying unit D can employ heating elements 2 of many kinds. Presently preferred adjustable heating elements 2 are infrared heaters of the type also known as heating rods. Suitable heating rods are shown and described in the aforementioned commonly owned U.S. Pat. No. 4,465,565 to Ertl et al. to which reference may be had if necessary.

The monitoring devices 5 and 7 in a drying unit which employs heating elements in the form of adjustable infrared heaters can constitute commercially available infrared radiation detectors which are capable of measuring the intensity of heat radiated by the heating elements 2. Suitable monitoring devices are photodiodes known as Type LD 274 distributed by Siemens. Such photodiodes are highly sensitive to infrared radiation. However, it is also possible to employ other types of monitoring devices, depending for example upon the absorptivity of webs to be dried. For example, the aforediscussed photodiodes can be replaced with wideband diodes, e.g., silicon diodes.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of drying a moist web which contains photographic material and comprises randomly distributed portions having different heat absorptivities, comprising the steps of advancing the web in a predetermined direction along a predetermined path; directing heat of variable intensity against the advancing web in at least one predetermined section of said path whereby said portions absorb different quantities of heat; monitoring the heat absorptivity of said portions in said at least one section and generating signals denoting the monitored absorptivities; and utilizing said signals to vary the intensity of directed heat.

2. The method of claim 1, wherein said monitoring step includes ascertaining the amounts of heat which penetrate through said portions of the advancing web.

3. The method of claim 1, wherein said monitoring step includes ascertaining the amounts of heat which is reflected by said portions of the advancing web.

4. The method of claim 1, further comprising the steps of monitoring the intensity of heat prior to impingement upon the advancing web in said at least one section of said path and generating second signals denoting the monitored intensity, and relating said second signals with signals denoting the monitored absorptivity, said utilizing step including varying the intensity of directed heat as a function of variations of said signals.

5. The method of claim 1, wherein said heat directing step includes directing heat against both sides of the advancing web in the at least one section of said path.

6. The method of claim 1, wherein said advancing step includes transporting the web along said at least one section of said path in a predetermined plane, said heat directing step including directing heat of variable intensity against at least one side of the advancing web at least substantially at right angles to said plane.

7. The method of claim 6, wherein said heat directing step includes directing heat from a plurality of sources forming at least one row disposed at the at least one side of the plane and being at least substantially equidistant from the plane, with the row extending transversely of the predetermined direction.

8. Apparatus for drying a moist web which contains photographic material and comprises randomly distributed portions having different heat absorptivities and is advanced in a predetermined direction along a predetermined path, comprising adjustable means for directing heat of variable intensity against the advancing web in at least one predetermined section of said path whereby said portions of the advancing web absorb different quantities of heat; means for monitoring the heat absorptivity of said portions in said at least one section of said path including means for generating signals denoting the monitored absorptivity; and means for adjusting said directing means as a function of variations of said signals.

9. The apparatus of claim 8, wherein said heat directing means includes at least one array of adjustable heating elements extending transversely of said direction at least at one side of said path.

10. The apparatus of claim 8, wherein said monitoring means includes means for monitoring the transmissivity of heat by said portions of the advancing web.

11. The apparatus of claim 8, further comprising means for limiting the range of said monitoring means.

12. The apparatus of claim 11, wherein said limiting means comprises means for confining said monitoring means to the monitoring of a predetermined part of the web in said at least one section of said path.

13. The apparatus of claim 8, further comprising means for directly monitoring the intensity of heat prior to impingement of directed heat upon the web in said at least one section of said path, including means for generating second signals denoting the monitored intensity, said adjusting means including means for adjusting said directing means as a function of variations of said second signals.

14. The apparatus of claim 8, wherein said heat directing means includes a battery of adjustable heating elements at each side of the web in said at least one section of said path.

15. The apparatus of claim 8, wherein said heat directing means comprises a plurality of adjustable heating elements and said monitoring means comprises a monitoring device for each of said heating elements.

16. The apparatus of claim 15, further comprising means for directly monitoring the intensity of heat from said heating elements prior to impingement of such heat upon the web in said at least one section of said path and for generating second signals denoting the monitored intensity, said adjusting means including means for adjusting said heating elements as a function of variations of said second signals, said intensity monitoring means comprising a discrete monitoring device for each of said heating elements.

* * * * *